US005408799A

United States Patent [19]

Ron et al.

[11] Patent Number: 5,408,799

[45] Date of Patent: Apr. 25, 1995

[54] MEMBERS FOR REINFORCING, SUPPORTING AND TYING STEEL BARS FOR REINFORCING CONCRETE

[76] Inventors: Eli Ron, 36 Yehuda Hanassi Str., Ramat Aviv Gimmel, 62309 Tel Aviv; Rina Yam, 40 Shenkar Street, Holon, both of Israel

[21] Appl. No.: 102,125

[22] Filed: Dec. 8, 1993

[30] Foreign Application Priority Data

Dec. 15, 1992 [IL] Israel ..... 104101

[51] Int. Cl.[6] ..... E04C 5/16

[52] U.S. Cl. ..... 52/677; 52/687; 52/678

[58] Field of Search ..... 52/677, 678, 679, 680, 52/683, 684, 687, 689; 404/130; 248/49

[56] References Cited

U.S. PATENT DOCUMENTS

| | | | |
|---|---|---|---|
| 1,043,199 | 11/1912 | Burk . | |
| 1,060,919 | 5/1913 | Luten | 52/684 |
| 1,139,987 | 5/1915 | Lukens . | |
| 1,409,645 | 3/1922 | Baker . | |
| 1,651,946 | 12/1927 | Burrell . | |
| 3,105,423 | 10/1963 | Reiland . | |
| 3,114,221 | 12/1963 | Eriksson . | |
| 3,512,330 | 5/1970 | Shlesinger | 52/677 |
| 3,736,719 | 6/1973 | Wise . | |
| 3,736,719 | 6/1973 | Wise . | |
| 4,034,529 | 7/1977 | Lampus . | |
| 4,073,114 | 2/1978 | Irish . | |
| 4,085,559 | 4/1978 | Ilukowicz . | |
| 4,748,785 | 6/1988 | Wheeler . | |
| 4,803,825 | 2/1989 | Wheeler . | |
| 4,831,803 | 5/1989 | Leonardis . | |
| 4,833,850 | 5/1989 | Lunn . | |
| 5,014,485 | 5/1991 | Chang . | |

FOREIGN PATENT DOCUMENTS

| | | | |
|---|---|---|---|
| 242910 | 2/1965 | Austria | 52/677 |
| 246963 | 5/1966 | Austria | 52/677 |
| 1126113 | 3/1962 | Germany | 52/684 |

*Primary Examiner*—Carl D. Friedman
*Assistant Examiner*—Creighton Smith
*Attorney, Agent, or Firm*—Benjamin J. Barish

[57] ABSTRACT

A supporting member for supporting steel reinforcing bars before casting concrete thereover when making steel-reinforced concrete panels includes an elongated strip of sheet material folded into a U-shape to include a pair of substantially parallel legs at one side of the supporting member joined together by a bent integral juncture at the opposite side of the supporting member. The bent integral juncture is formed with a plurality of axially-spaced slots extending into the legs but terminating short of their bottom edges for receiving and supporting the bars transversely across the legs. Also described are a method of making such a supporting member, and a steel-reinforcement concrete panel including a plurality of such supporting members.

16 Claims, 9 Drawing Sheets

MEMBERS FOR REINFORCING, SUPPORTING AND TYING STEEL BARS FOR REINFORCING CONCRETE

FIELD AND BACKGROUND OF THE INVENTION

The present invention relates to reinforcing and supporting members for supporting steel reinforcing bars before casting concrete thereover when making steel-reinforced concrete panels. The invention also relates to a method of making such supporting members, and also to the steel-reinforced concrete panels including such supporting members.

The term "panel", as used herein, includes not only pre-cast panels but also panels cast in situ. Further, this term includes panels used for making horizontal members such as floors, ceilings and beams; vertical members such as walls and columns; diagonal members, such as staircases; or members of other orientations.

Concrete panels of the foregoing types generally include two groups of steel reinforcing bars, one group extending parallel to each other along one orthogonal axis, and the other group extending parallel to each other along the other orthogonal axis or at other angles. The bars of the two groups are generally tied to each other at their intersection points before casting the concrete to immobilize them when casting the concrete until the concrete is hardened. Tying together the two groups of bars requires considerable labor and time, which thereby increases the overall cost and time in producing the panels.

OBJECTS AND BRIEF SUMMARY OF THE INVENTION

An object of the present invention is to provide reinforcing and supporting members enabling steel-reinforced concrete panels to be constructed in less time and/or at lower cost than in the conventional method. Another object of the invention is to provide a method of producing such a supporting panel so it will stay in place and not move horizontally and vertically; and a still further object is to provide steel-reinforced concrete panels constructed with such supporting members.

According to, the present invention, there is provided a supporting member for supporting steel reinforcing bars of predetermined thickness before casting concrete thereover when making steel-reinforced concrete panels, characterized in that the supporting member comprises an elongated strip of sheet material folded into a U-shape to include a pair of substantially parallel legs, having bottom edges, at one side of the supporting member joined together by a bent integral juncture at the side of the supporting member opposite to the one side. The bent integral juncture is formed with a plurality of axially-spaced slots extending into the legs but terminating short of the bottom edges of the legs for receiving and supporting the bars transversely across the legs. The slots in the bent integral juncture and the pair of legs are of larger axial dimension than the thickness of the steel bars. Each of the slots has a bottom and an inclined surface along one side of the slot directing the bar received therein to the bottom of the side of the slot opposite to the inclined surface. The supporting member further includes an axial projection in the bent integral juncture overlying the opposite side of the slot and the bar when received therein.

Preferably, the supporting member, which is part of the reinforcing, is made of steel sheet formed with the slots and bent into the U-shape.

According to still further features in the described preferred embodiment, the bent integral juncture is formed with a second plurality of axially-spaced slots between the first-mentioned slots and extending for a substantially smaller distance into the legs than the first-mentioned slots. The second plurality of slots are effective to increase the bonding surface of the supporting member with the concrete when cast thereover and also to decrease the weight and material of the supporting member.

According to still further features in the described preferred embodiment, the pair of substantially parallel legs are formed with a third plurality of slots extending from the bottom of the legs and terminating short of the bent integral juncture, the third plurality of slots being effective to further increase the bonding surface of the supporting member with the concrete when cast thereover and also to further decrease the weight and material of the supporting member.

As will be described more particularly below, the use of such supporting members in making steel-reinforced concrete panels avoids the need for tying the steel bars in place, and thereby substantially reduces the time required for producing such concrete panels. In addition, by using steel sheet material for the supporting members, the supporting members can take the place of many or all of the transverse steel bars extending across the group of longitudinal steel bars, so that the transverse bars may be reduced in number or eliminated altogether.

The invention also provides a method of making the above-described supporting members, comprising: providing a flat, elongated strip of sheet material; stamping out the slots while the strip is flat; and then bending the strip into the U-shape.

The invention further provides a steel-reinforced concrete panel comprising a plurality of the above-described supporting members extending in parallel to each other along one orthogonal axis of the panel; and concrete embedding the supporting members and steel bars.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
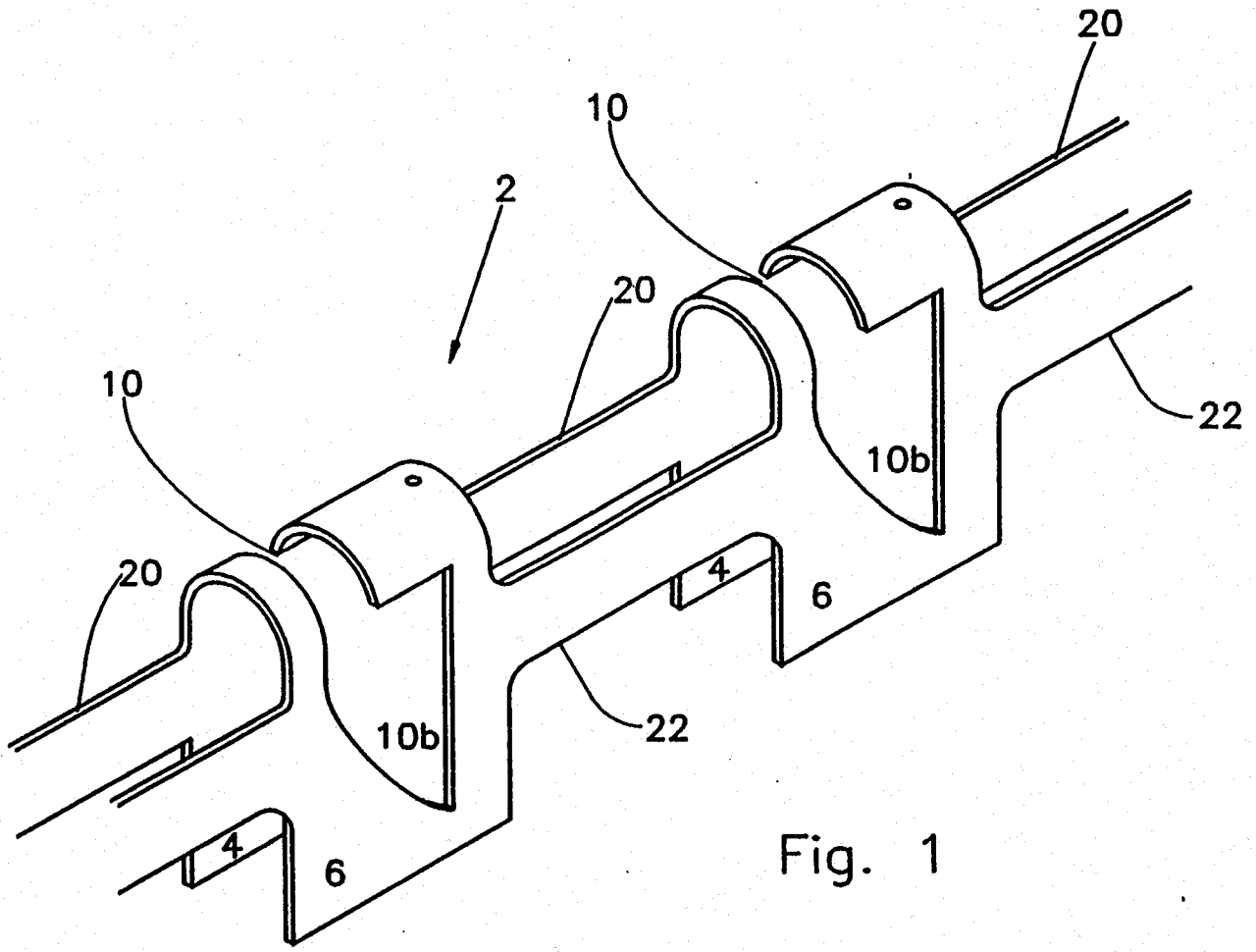
FIG. 1 is a three-dimensional view illustrating one form of supporting member constructed in accordance with the present invention.
Figure 3:
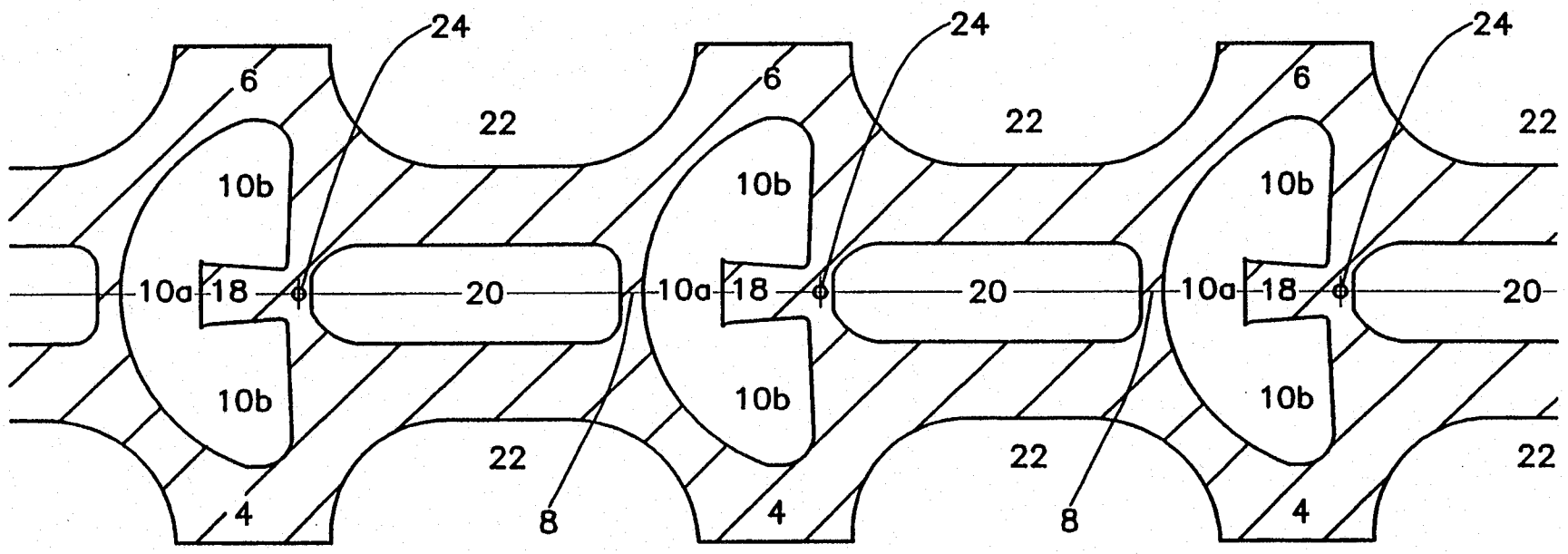
FIG. 3 illustrates the supporting member of FIG. 1 in its initial, flat condition, before bending.

With reference to FIG. 1, there is illustrated one form of supporting member, generally designated 2, constructed in accordance with the present invention. The supporting member illustrated is formed of an elongated strip of steel sheet material which is initially in a flat condition as illustrated in FIG. 3, and is then bent into a U-shape as shown in FIGS. 1 and 5–7, to include a pair of substantially parallel legs 4, 6 at one side joined together by a bent integral juncture 8 at the opposite side.

Figure 2:
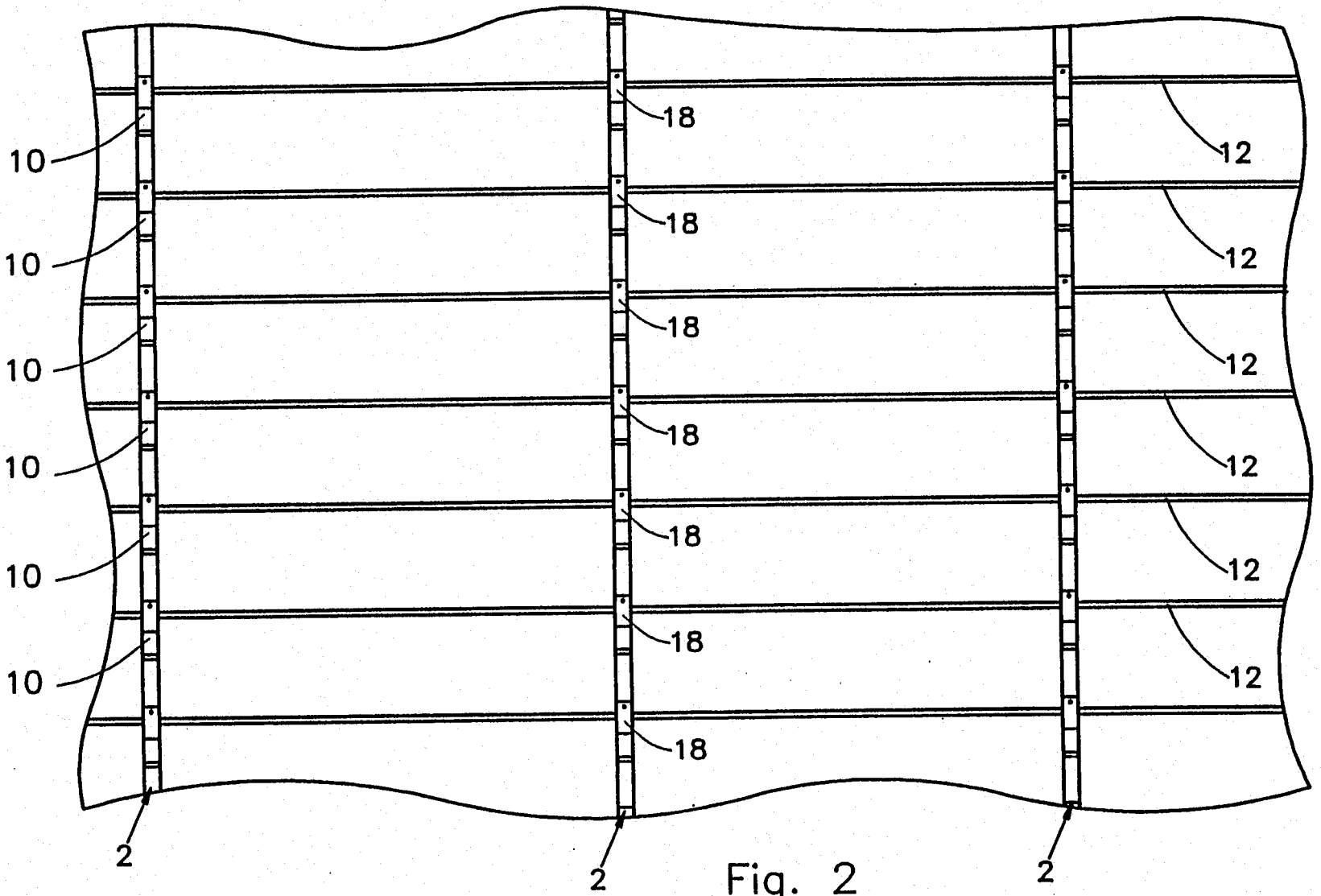
FIG. 2 is a top plan view illustrating a plurality of the supporting members of FIG. 1 for supporting a plurality of steel bars extending transversely across the steel members before casting the concrete.

The bent integral juncture 8 is formed with a plurality of axially-spaced slots 10. Each slot includes a portion 10*a* extending through the bent integral juncture 8 of the supporting member, and a portion 10*b* extending through each of the legs 4, 6. The latter portions terminate short of the lower ends of the legs. Slots 10 are used for receiving and supporting the reinforcing bars, shown at 12 in FIGS. 2 and 5, before the concrete is cast.

Figure 4:
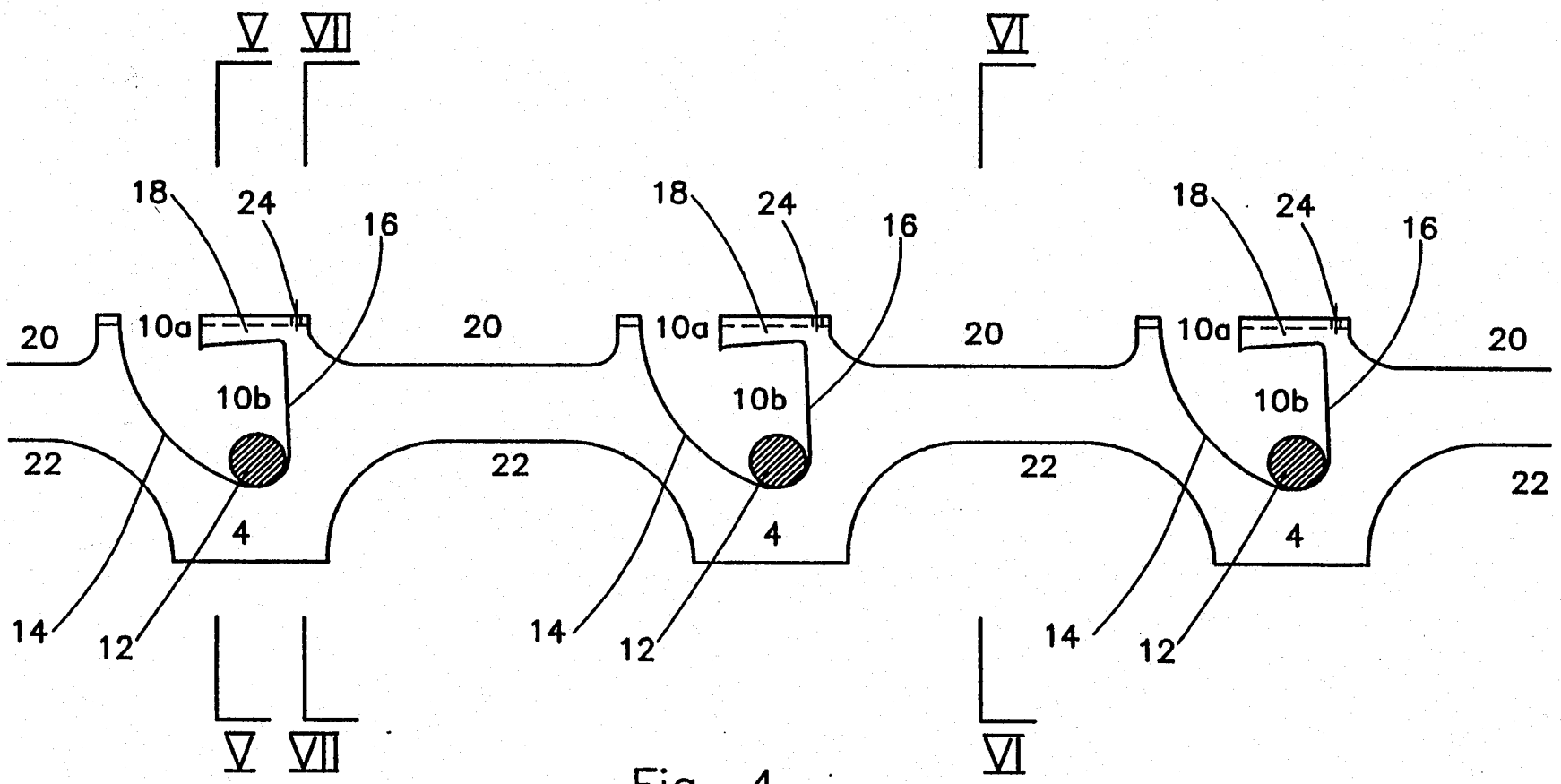
FIG. 4 is a side elevational view illustrating the supporting panel of FIG. 1.
Figure 4A:
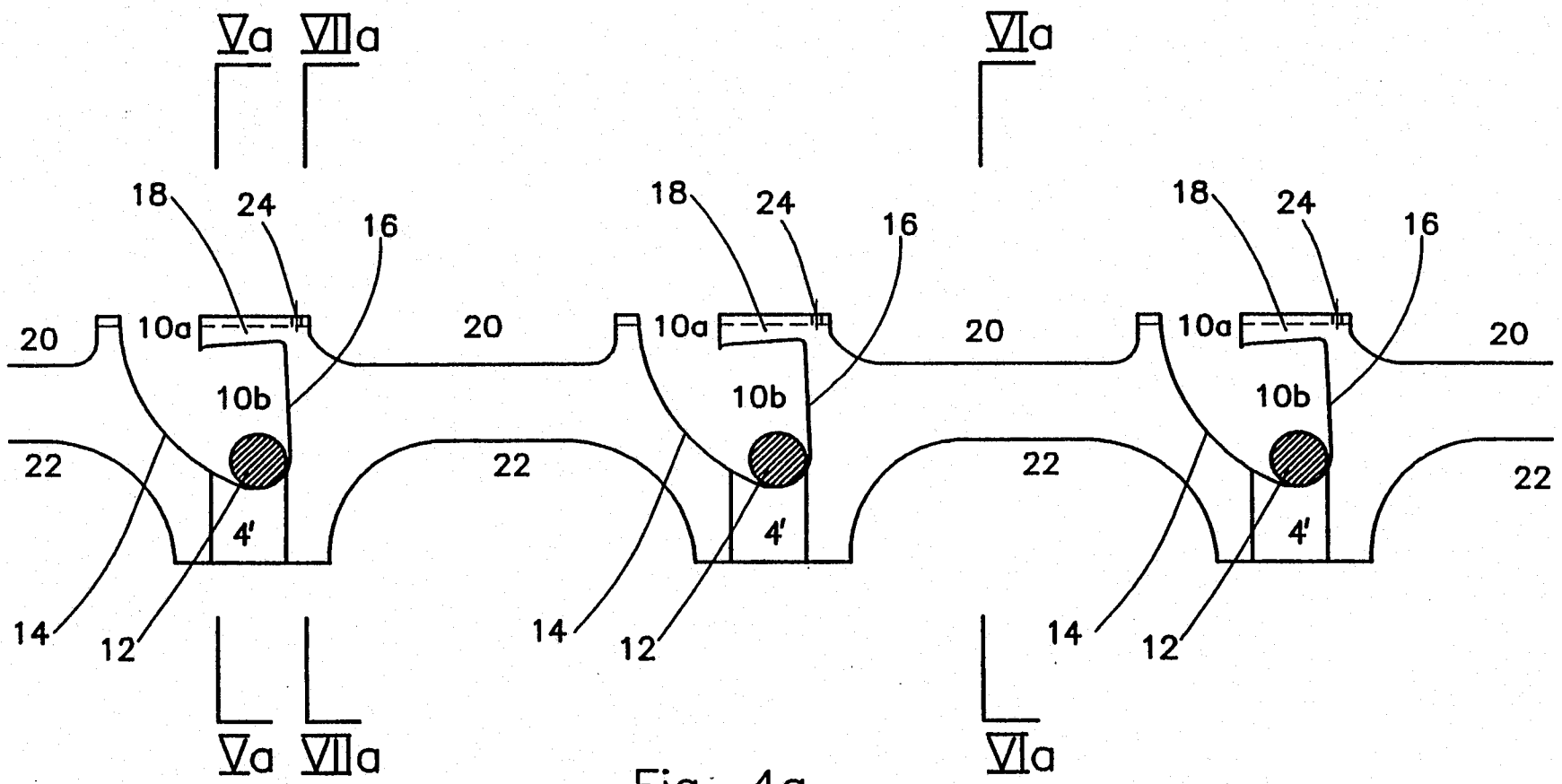
Figure 7:
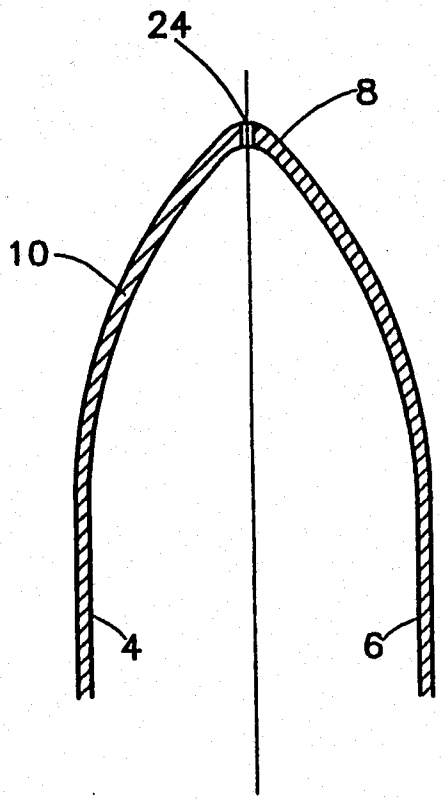
FIGS. 5, 6, and 7 are sectional views along lines V—V, VI—VI and VII—VII, respectively, of FIG. 4.
Figure 6:
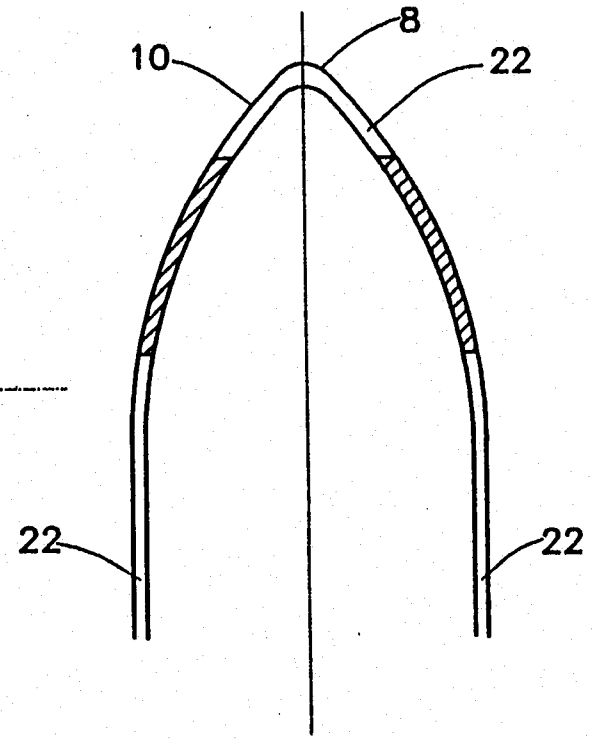
Figure 5:
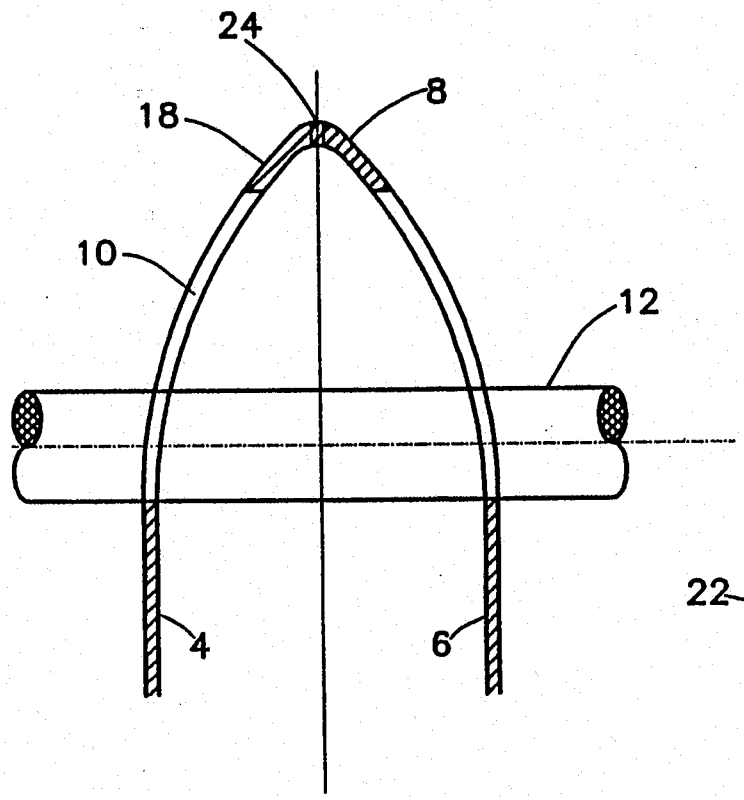
Figure 7A:
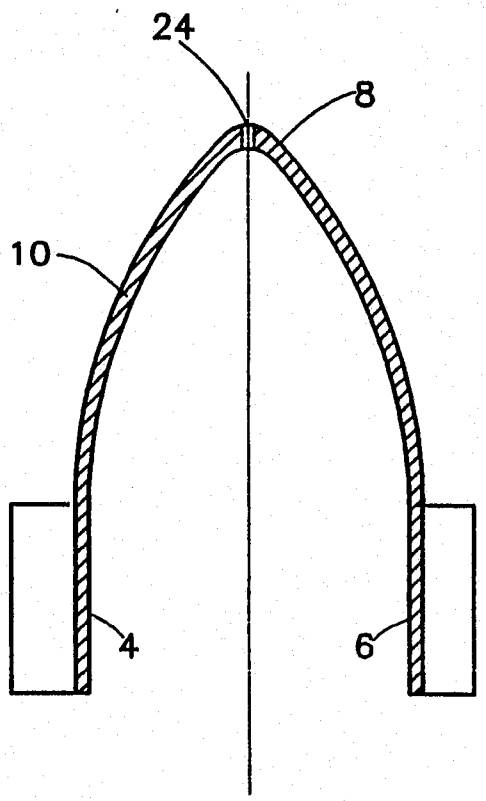
Figure 6A:
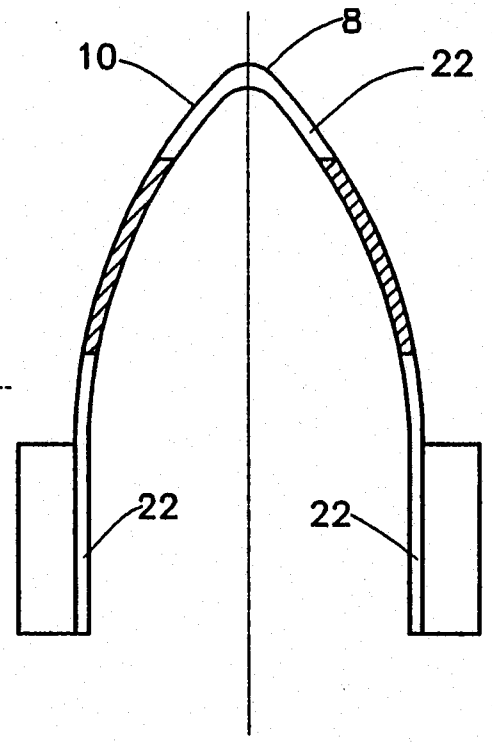
Figure 5A:
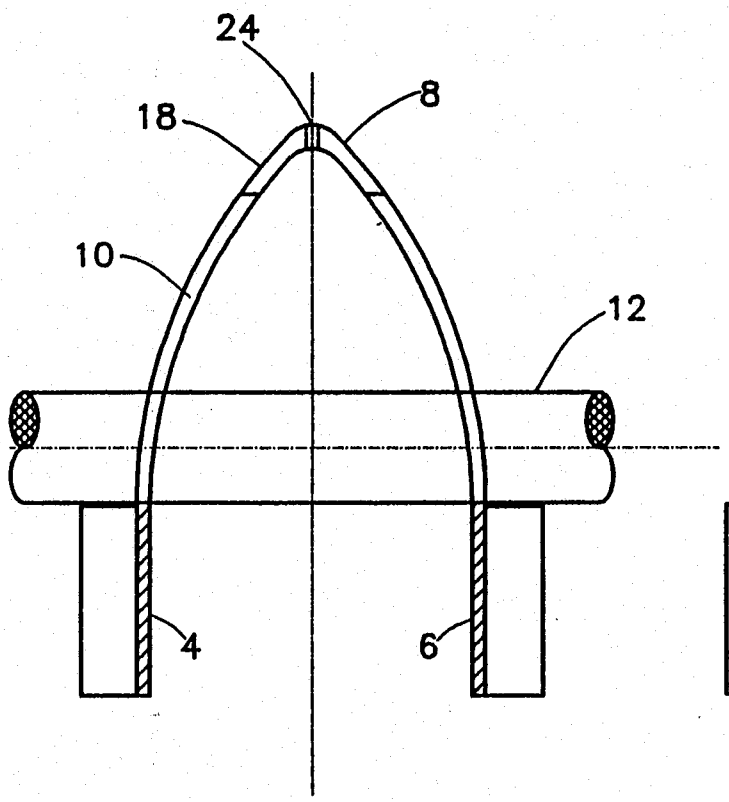

As shown particularly in FIG. 4, each of the slot portions 10*b* extending through the legs 4, 6, includes an inclined surface 14 along one side of the slot which directs the bar 12 received therein to the bottom of the slot at the opposite side 16. As also clearly seen in FIG. 4, slot portion 10*a* in the bent integral juncture 8 of the supporting member is of a larger axial dimension than the thickness (diameter) of the steel bars 12. Thus, the steel bars 12 may be conveniently introduced through slot portions 10*a*, whereupon the inclined side 14 of the leg slot portions 10*b* guide the bars towards the opposite sides 16 of the slot.

The bent integral juncture 8 of the supporting member 2 is further formed with an axial projection 18 in slot portion 10*a* overlying side 16 of the slot leg portions 10*b*. Projections 18 thus overlie the steel bars 12 when received within the leg portions 10*b* of slots 10, as shown in FIG. 4, and thereby prevent the unseating of the steel bars out of slots 10 during the casting of the concrete.

The bent integral juncture 8 of the supporting member is formed with a second plurality of axially-spaced slots 20 between slots 10. Slots 20 are of generally rectangular configuration with rounded ends and extend only for a short distance, much shorter than slots 10, in the pair of legs 4, 6 of the supporting member.

The supporting member is formed with a third plurality of slots 22 extending from the bottom edges of the legs 4, 6 and terminating short of the bent integral juncture 8. Slots 22 are substantially aligned with slots 20 but are of slightly longer axial length than those slots, as clearly seen in FIG. 3 for example.

The supporting member is preferably further formed with a fourth plurality of slots 23, or holes, of circular shape and extending through the axial projections 18.

Slots 20, 22 and 23 are effective to increase the bonding surface with the concrete when cast over the supporting member and the steel bars received by the supporting member to enable the concrete to be continuous and to decrease the possible formation of air pockets. These slots also decrease the weight and material of the supporting member. If desired, slots 22 may also be used for accommodating electrical wiring, ducts, pipes, or the like. The circular slots or holes 23 may also be used for receiving nails or other fasteners to fasten the supporting members to the forms when casting the concrete in a non-horizontal position.

All four groups of slots 10, 20, 22 and 23 are formed in the supporting member 2 when in its initial flat condition, as illustrated in FIG. 3. These slots may be formed by conventional punching equipment. The strip with the punched slots is then bent into the U-shape as illustrated in FIGS. 1 and 5–7 by conventional means, such as rollers engaging the opposite sides of the strip. As one example, the strip may be of steel sheet material at least 0.6 mm in thickness.

The manner of using the supporting members 2 for making concrete panels will be apparent from the above description. Thus, a plurality of the supporting members 2 are supported in spaced parallel relation to extend along one orthogonal axis, and a plurality of the steel bars 12 are then received via the slots 10 so as to extend in parallel along the other orthogonal axis (FIG. 2), or at another angle to the first axis. As each bar is inserted into portion 10*a* of the slot, it is directed by the inclined wall 14 in the legs 4 and 6 to move to the bottom of the leg portion 10*b* of the slot adjacent the opposite wall 16, and thereby to underlie projection 18 in the bent integral juncture 8 of the supporting member. Accordingly, when the concrete is cast, projection 18 will prevent the steel bars 12 from unseating from their respective slots.

Figure 8:
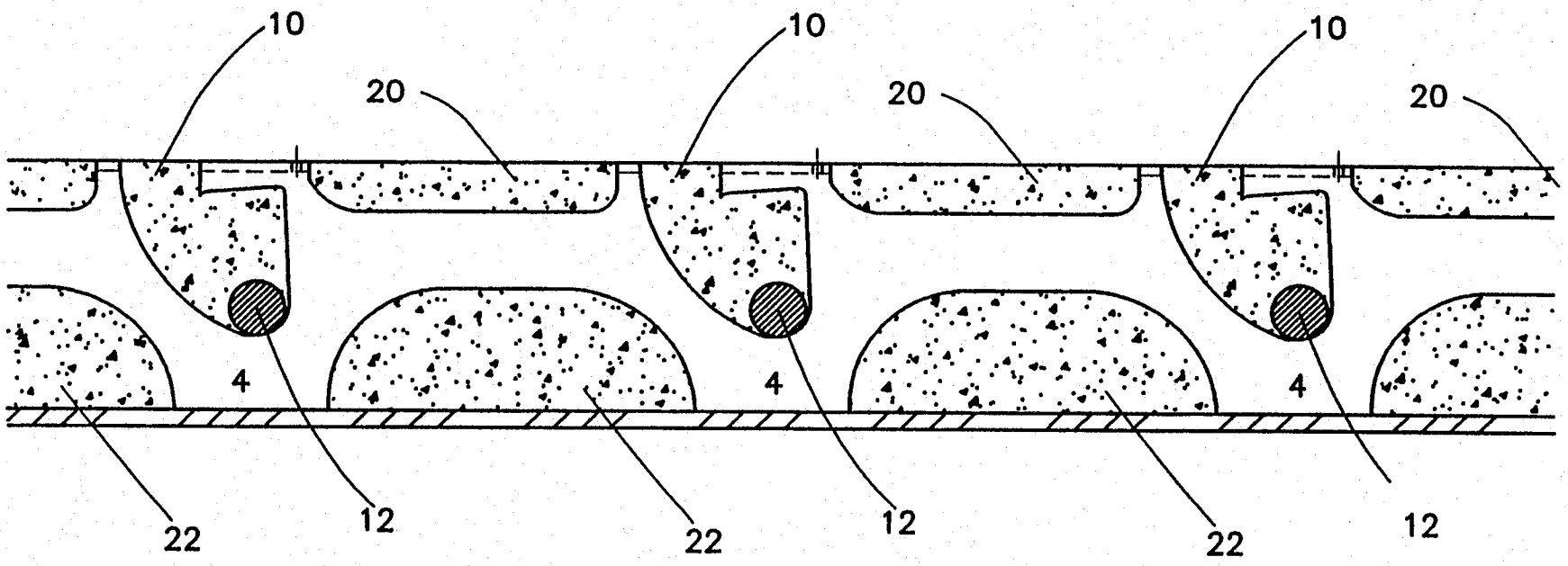
FIG. 8 is a fragmentary sectional view illustrating one form of steel-reinforced concrete panel including the supporting members of FIGS. 1–7.

FIG. 8 illustrates a steel-reinforced panel constructed as described above. Preferably, the supporting members are of a height of 5 cm, and the concrete is cast to be flush with the upper and lower surfaces of the supporting members 2 while resting on the forms (on the ground), and to extend at least 1.5 cm from both the upper and lower surfaces of the steel reinforcing bars 12 so as to completely embed the bars and to prevent rusting.

Figure 9:
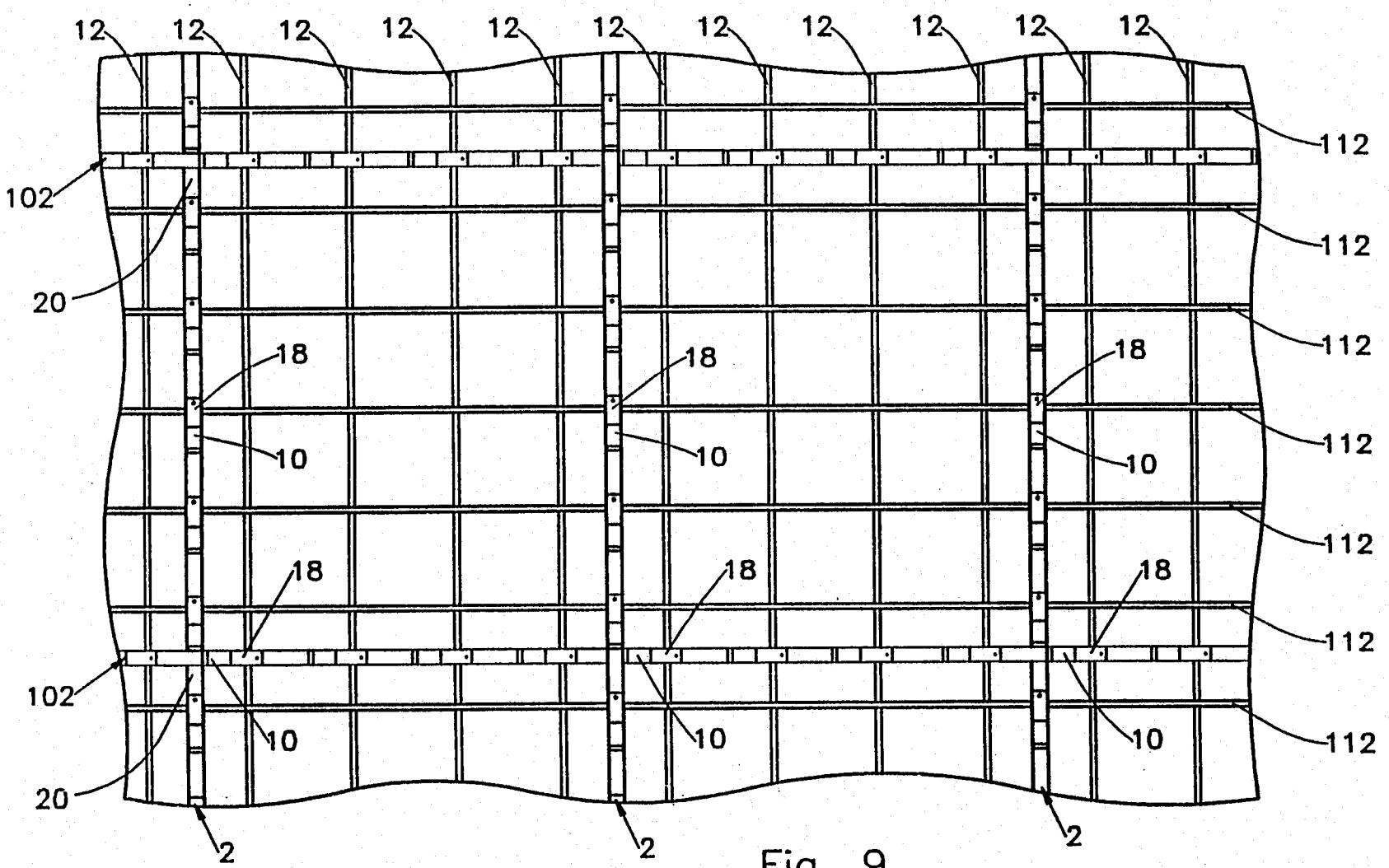
FIG. 9 is a fragmentary sectional view illustrating a second form of steel-reinforced concrete panel including the supporting members of FIGS. 1–7.

FIG. 9 illustrates a steel-reinforced panel constructed with two groups of supporting members, shown at 2 and 102, respectively, each supporting a plurality of reinforcing bars 12 and 112, respectively. Thus, the second group of supporting members 102 is applied across the first group of supporting members 2 with the lower slots (corresponding to slot 22 in members 2) of members 102 received in slots 20 of members 2. Accordingly, the overall thickness of the panel is somewhat less than twice the thickness of the panel illustrated in FIG. 8. The second group of supporting members 102 would preferably be applied perpendicularly to the first group of supporting members 2, but could be applied at a different angle. Similarly, the steel bars 12 and 112 received in their respective supporting members 2 and 102 would preferably be applied perpendicularly to their respective supporting members, but could also conceivably be applied at another angle.

It will thus be seen that the supporting members 2 permit the reinforcing bars 12 to be applied in a quick and facile manner and eliminate the need for tying the supporting bars in place before the concrete is cast. In addition, the supporting members 2 impart high mechanical strength to the panel, and therefore can serve the function of the transversly-extending reinforcing bars normally provided in concrete panels of this type. Thus, the use of supporting members 10 in a single-layer panel (FIG. 8) can reduce the number of, or eliminate, the transversely-extending supporting bars (e.g., 12).

The supporting members may be of fixed dimensions, e.g., 5 cm in height. Thus, when the concrete shutters are applied directly in contact with their opposites surfaces, the supporting members themselves fix the thickness of the concrete panel produced.

While the invention has been described with respect to one preferred embodiment, it will be appreciated that this is set forth purely for purposes of example, and that many other variations, modifications and applications of the invention may be made.

What is claimed is:

1. A supporting member for supporting steel reinforcing bars of predetermined thickness before casting concrete thereover when making steel-reinforced concrete panels, characterized in that said supporting member comprises an elongated strip of sheet material folded into a U-shape to include a pair of substantially parallel legs, having bottom edges, at one side of the supporting member joined together by a bent integral juncture at the side of the supporting member opposite to said one side; said bent integral juncture being formed with a plurality of axially-spaced slots extending into said legs but terminating short of the bottom edges of said legs for receiving and supporting said bars transversely across said legs; said slots in said bent integral juncture and said pair of legs being of larger axial dimension than the thickness of said steel bars; each of said slots having a bottom and an inclined surface along one side of the slot directing the bar received therein to the bottom of the side of the slot opposite to said inclined surface; and an axial projection in said bent integral juncture overlying said opposite side of the slot and the bar when received therein.

2. The supporting member according to claim 1, wherein said supporting member is made of steel sheet formed with said slots and bent into said U-shape.

3. The supporting member according to claim 1, wherein said bent integral juncture is formed with a second plurality of axially-spaced slots between said first-mentioned slots and extending for a substantially smaller distance into said legs than said first-mentioned slots.

4. The supporting member according to claim 3, wherein said pair of legs are formed with a third plurality of slots extending from the bottom of said legs and terminating short of said bent integral juncture.

5. The supporting member according to claim 4, wherein wherein said third plurality of slots formed in said legs are substantially aligned with, but of slightly longer axial length than, said second plurality of slots.

6. The supporting member according to claim 5, wherein said third plurality of slots formed in said legs terminate above the bottoms of said first-mentioned slots formed in said legs.

7. The supporting member according to claim 1, wherein each of said axial projections is formed with a further slot therethrough.

8. A supporting member for supporting steel reinforcing bars of predetermined thickness before casting concrete thereover when making steel-reinforced concrete panels, said supporting member comprising:

an elongated strip of sheet material folded into a U-shape to include a pair of substantially parallel legs, having bottom edges, at one side of the supporting member joined together by a bent integral juncture at the side of the supporting member, opposite to said one side;

said bent integral juncture being formed with a plurality of axially-spaced slots having portions extending into said legs but terminating short of bottom edges of said legs for receiving and supporting said bars transversely across said legs;

said slots in said bent integral juncture and said pair of legs being of larger axial dimension than the thickness of said steel bars;

the portion of each of said slots extending into said legs having a bottom and an inclined surface along one side of the slot directing the bar received therein to the bottom of the side of the slot opposite to said inclined surface;

the portion of each of said slots in said bent integral juncture further including an axial projection overlying said opposite side of the slot and the bar when received therein.

9. The supporting member according to claim 8, wherein each of said axial projections is formed with a further slot therethrough.

10. The supporting member according to claim 8, wherein said bent integral juncture is formed with a second plurality of axially-spaced slots between said first-mentioned slots and extending for a substantially smaller distance into said legs than said first-mentioned slots.

11. The supporting member according to claim 10, wherein said pair of substantially parallel legs are formed with a third plurality of slots extending from the bottom of said legs and terminating short of said bent integral juncture.

12. The supporting member according to claim 11, wherein wherein said third plurality of slots formed in said legs are substantially aligned with, but of slightly longer axial length than, said second plurality of slots.

13. The supporting member according to claim 12, wherein said third plurality of slots formed in said legs terminate above the bottoms of said first-mentioned slots formed in said legs.

14. A method making the supporting member of claim 1, comprising: providing a flat, elongated strip of sheet material; stamping out said slots while the strip is flat; and then bending said strip into said U-shape.

15. A steel-reinforced concrete panel having two orthogonal axes, comprising: a plurality of supporting members each according to claim 1, extending parallel to each other along one orthogonal axis of the panel; a plurality of steel bars received in said first-mentioned slots and extending parallel to each other along the other orthogonal axis of the panel; and concrete embedding said supporting members and steel bars.

16. The steel-reinforced concrete panel according to claim 15, further including a second plurality of supporting members extending in parallel to each other along an axis at an angle to said one orthogonal axis of said first plurality of supporting members; and a second plurality of steel bars received in said first-mentioned slots of said second plurality of supporting members and extending parallel to each other perpendicular to said axis of said second plurality of supporting members; said concrete embedding both pluralities of supporting members and steel bars.

* * * * *